United States Patent [19]

Watkins

[11] 4,248,514

[45] Feb. 3, 1981

[54] PHOTOGRAPHIC PROCESSING APPARATUS

[76] Inventor: James L. Watkins, Appleby, Rosebery Rd., Tokers Green, Reading, Berkshire, England

[21] Appl. No.: 83,474

[22] Filed: Oct. 10, 1979

[51] Int. Cl.[3] ..... G03D 3/06

[52] U.S. Cl. ..... 354/299; 354/312; 354/323; 354/324; 354/330

[58] Field of Search ..... 354/299, 307, 312, 323, 354/324, 328, 329, 330

[56] References Cited

U.S. PATENT DOCUMENTS

| | | | |
|---|---|---|---|
| 2,825,272 | 3/1958 | Mader | 354/323 |
| 3,508,483 | 4/1970 | Weider et al. | 354/323 |
| 3,554,108 | 1/1971 | Gall | 354/323 |
| 3,623,416 | 11/1971 | Anderberg | 354/323 |
| 3,840,214 | 10/1974 | Merz | 354/330 |
| 4,054,902 | 10/1977 | Robek | 354/323 |

FOREIGN PATENT DOCUMENTS

| | | | |
|---|---|---|---|
| 1284722 | 8/1972 | United Kingdom | 354/330 |

*Primary Examiner*—L. T. Hix
*Assistant Examiner*—Alan Mathews
*Attorney, Agent, or Firm*—Charles W. Helzer

[57] ABSTRACT

A photographic processing apparatus including an air tight chamber mounted for angular movement about an axis. A pump is connected to the interior of the chamber. A valve connects the inlet of the pump either to a reservoir so that processing fluid may be introduced into the chamber or to the atmosphere so that air under pressure can be introduced into the chamber to force processing fluid therein out of the chamber through a chamber outlet.

29 Claims, 11 Drawing Figures

PHOTOGRAPHIC PROCESSING APPARATUS

Figure 1:
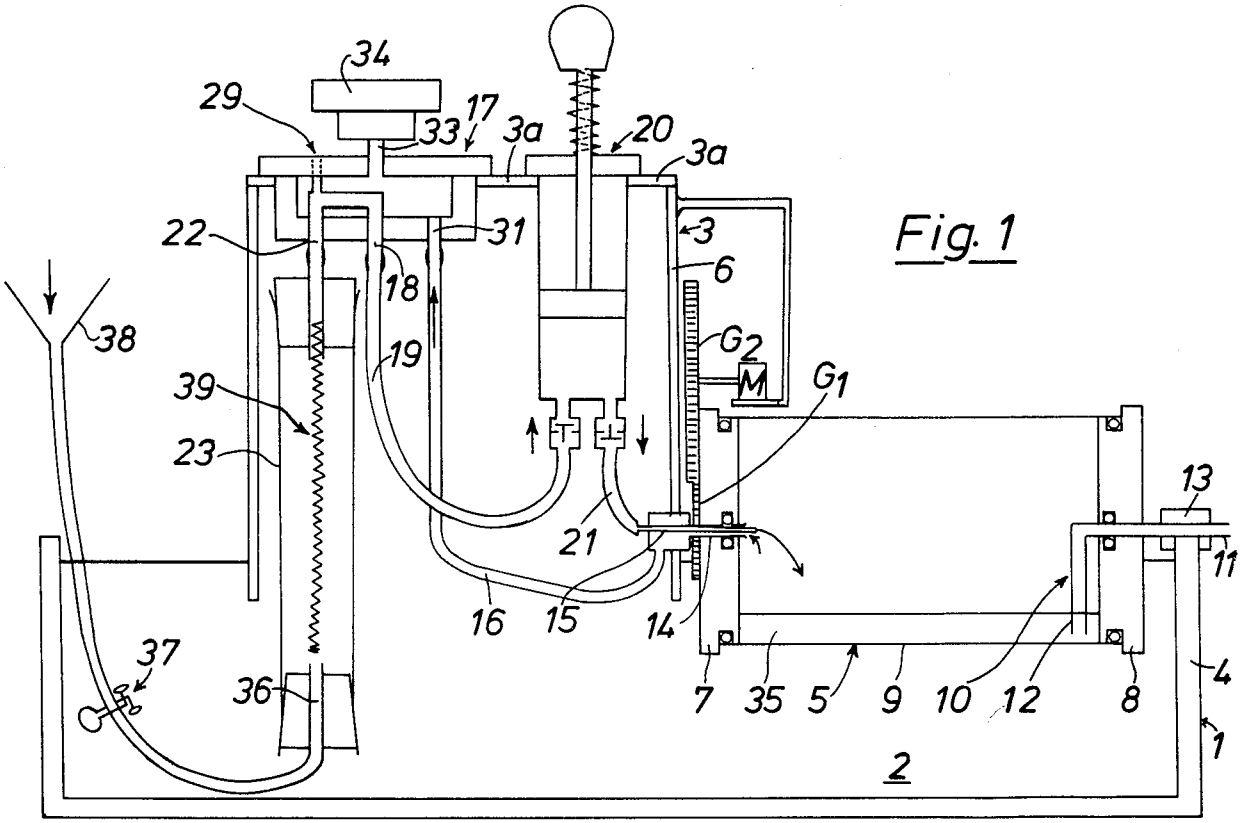

This invention relates to photographic processing apparatus.

Photographic processing equipment for use principally by amateurs is known (e.g. from U.K. Pat. No. 1,284,722) to comprise an angularly movable drum in which a web or sheet of photographic light-sensitized material (e.g. exposed film or paper to be transformed into a negative, a positive or a print) is processed by reactive surfacial contact with processing fluid within the drum. In use of such known photographic processing equipment, the drum is rotated or oscillated about an axis generally coaxial with the drum axis to disturb or agitate a puddle of the processing fluid within the drum into reactive surfacial contact of the web or sheet. Where, as is usual, the process involves the use of several processing fluids in sequence, e.g. developer fluid, bleach/fixing fluid, washing fluid (e.g. water), stabilizer fluid, and final washing fluid (e.g. water), it is necessary to discharge each processing fluid from the drum prior to charging the drum with the next processing fluid of the sequence. To effect such charging and discharging, it is necessary to stop the angular movement of the drum and up-end the drum so that the used processing fluid within the drum can pour out from a port at one end of the drum, and then to charge the drum, either through the same port or a like port at the other end of the drum, with fresh different processing fluid.

This procedure is time-consuming and laborious and gives rise to variations in the quality of the end product produced by repeated use of such processing equipment.

It is thus desirable to provide processing equipment that can be rapidly, and preferably automatically, charged and discharged with each of a sequence of processing fluids.

The present invention provides photographic processing apparatus comprising a substantially airtight chamber mounted for angular movement about an axis, at least one reservoir for a photographic processing fluid, pump means for introducing processing fluid into and discharging it from the interior of said chamber, and valve means for controlling the introduction of processing fluid into and discharge of processing fluid from the interior of said chamber, the outlet of the pump means being connected to the interior of the chamber and the valve means being operable to connect the inlet of the pump means either to said at least one reservoir so that processing fluid may be withdrawn from said at least one reservoir and introduced into the chamber or to atmosphere so that air under pressure can be introduced into the chamber to force processing fluid therein out of the chamber through a chamber outlet.

Preferably a discharge passage communicates with the interior of the chamber at the axis thereof.

In use of such apparatus, a puddle of processing fluid can be discharged out of the chamber through the outlet passage by subjecting the chamber to a pressure above atmospheric (e.g. 2 to 5 psi above atmospheric pressure).

Preferably the chamber is provided with a fluid inlet passage and the said pump means is connectable to said fluid inlet passage for use in pressurising the chamber for discharge of processing fluid therefrom through said outlet passage.

Preferably the processing apparatus comprises a plurality of reservoirs for processing fluid each selectively connectable to said fluid inlet passage via said pump means whereby the chamber may be charged with a selected processing fluid. Advantageously the valve means comprises multi-inlet selector valve means to connect selectively a said processing fluid reservoir and/or air to said fluid inlet passage. Preferably, each reservoir comprises an air-tight chamber having a deformable wall such that the chamber volume may decrease as processing fluid is removed therefrom.

Figure 3:
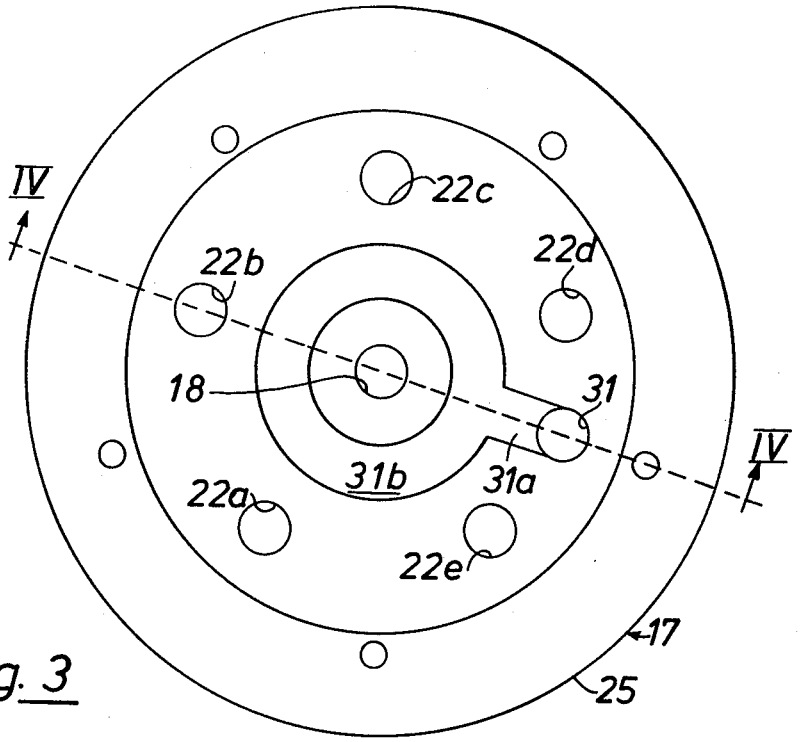
Figure 2:
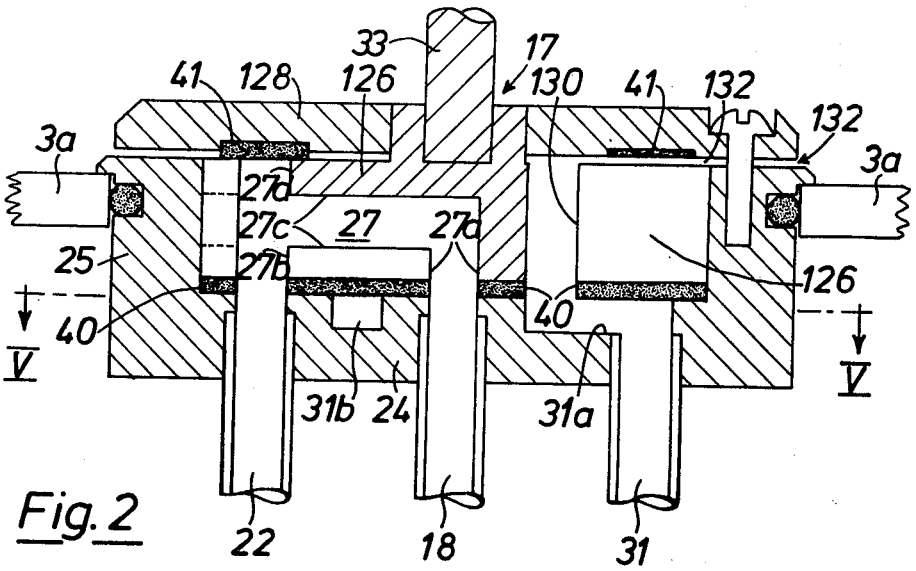
Figure 5:
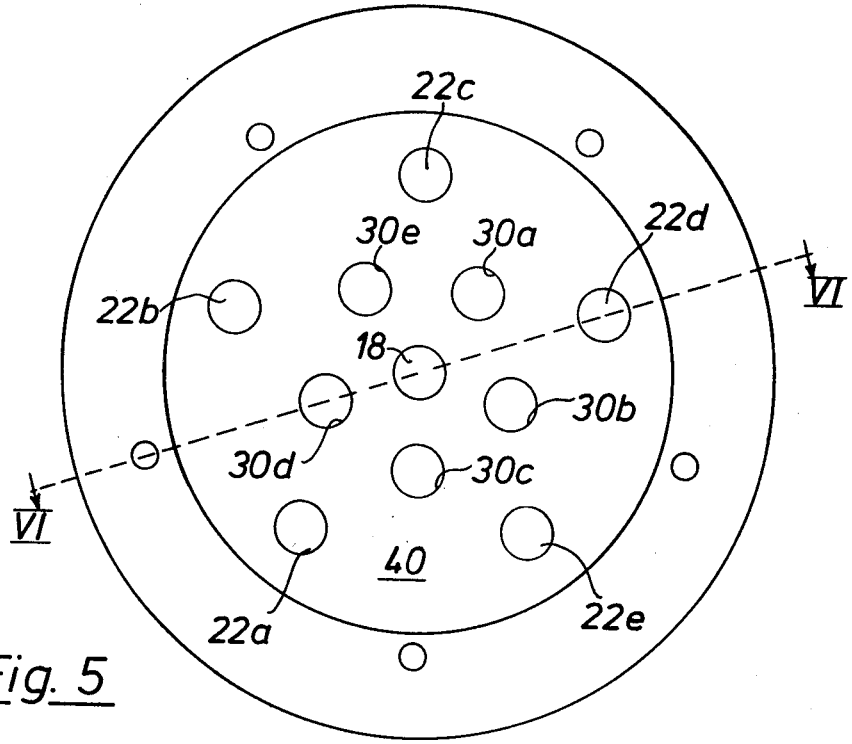
Figure 4:
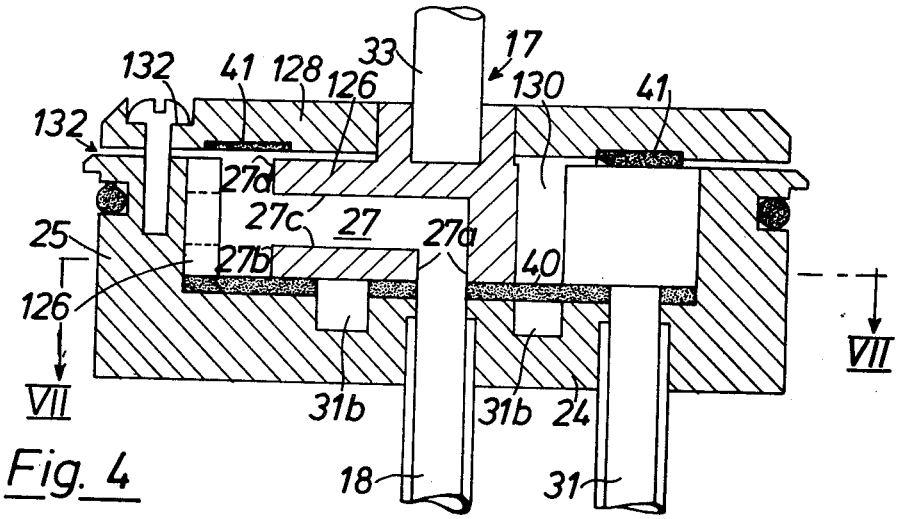
Figure 6:
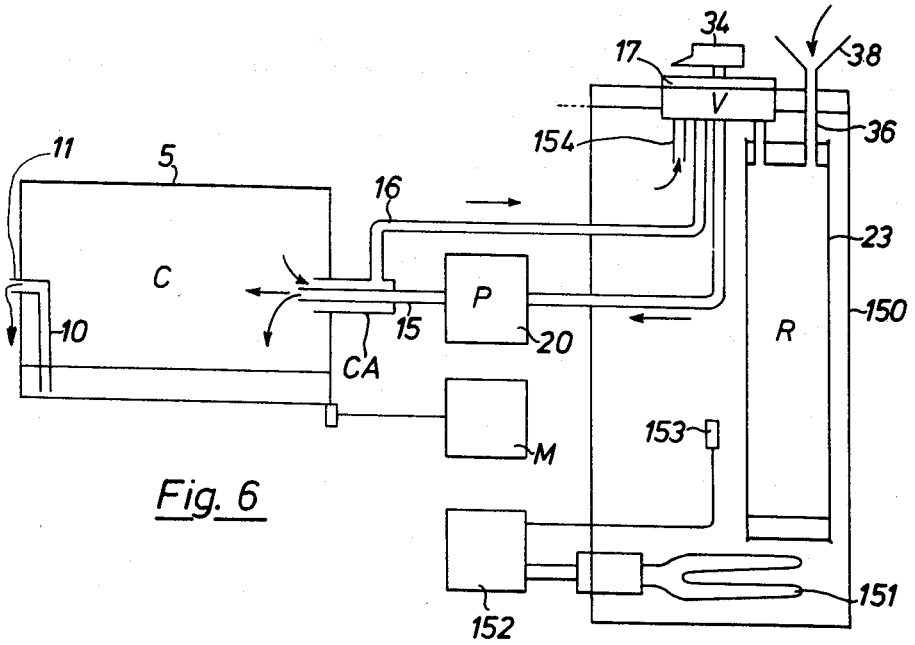
Figure 7:
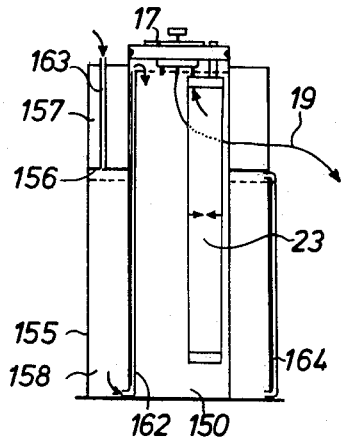
Figure 8:
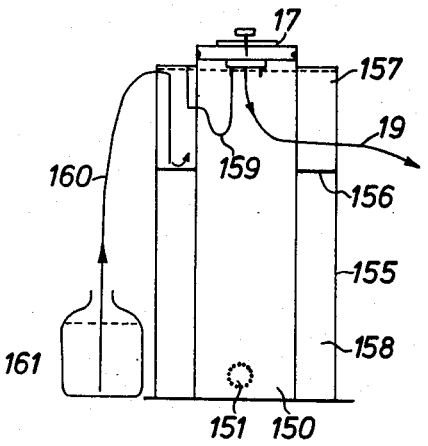
Figure 9:
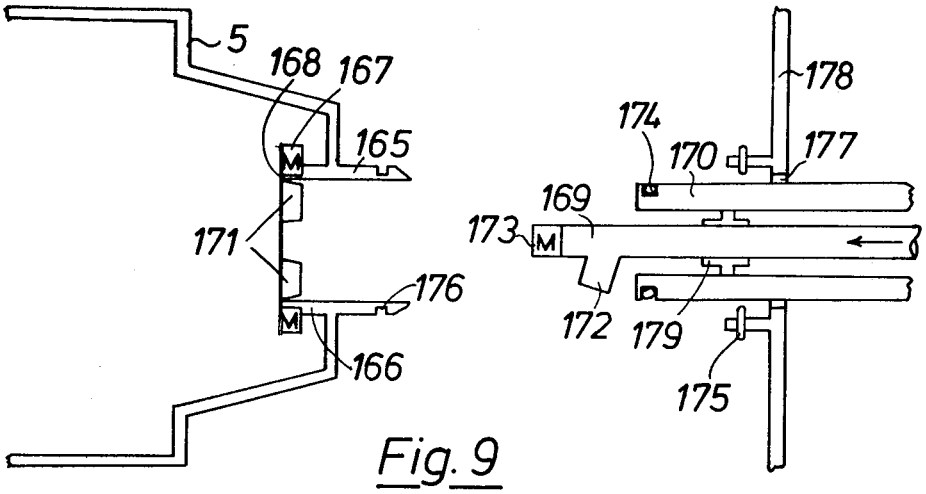
Figure 10:
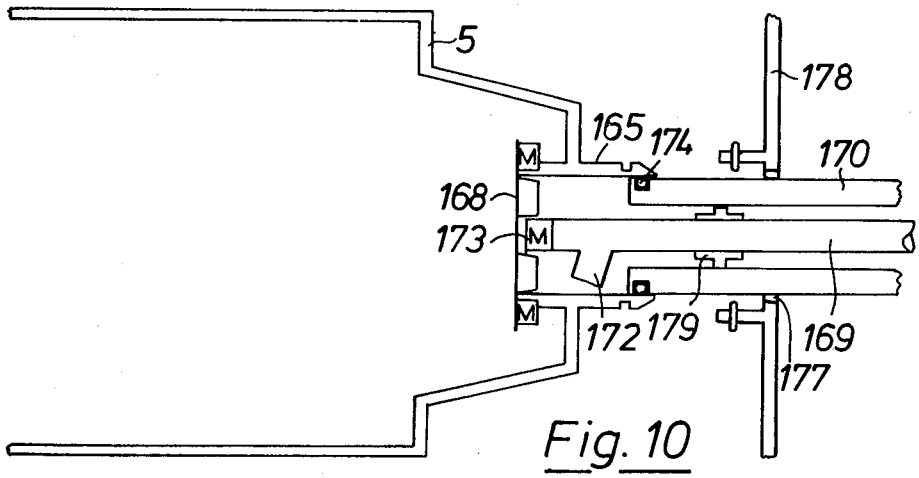
Figure 11:
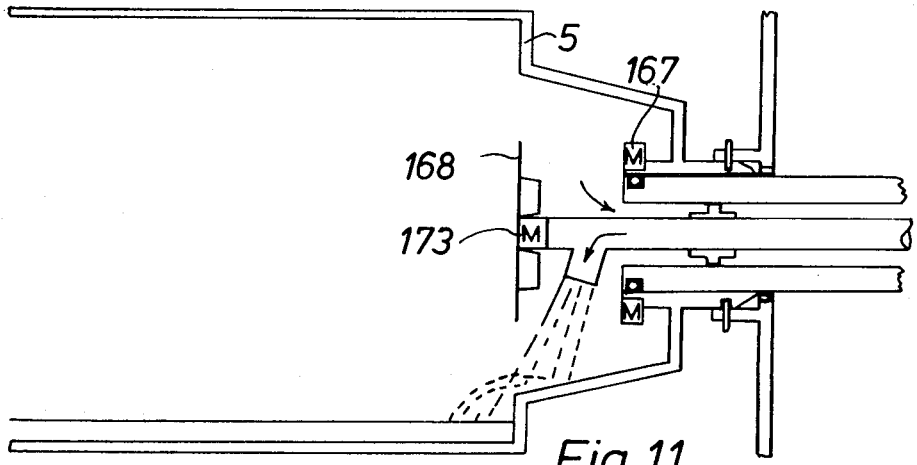

By way of example, embodiments of this invention will now be described with reference to the accompanying drawings, in which:

FIG. 1 is a diagrammatic side view of one embodiment of photographic processing apparatus according to the invention, FIG. 2 is a diagrammatic cross-section view (along the line IV—IV of FIG. 3) of a selector valve means for the apparatus of FIG. 1, FIG. 3 is a cross-sectional view along the line V—V of FIG. 2, FIG. 4 is a similar view to FIG. 2 (along the line VI—VI of FIG. 5) showing parts of the valve means in a different position, and FIG. 5 is a cross-sectional view along the line VII—VII of FIG. 4, FIG. 6 is a diagrammatic side view of another embodiment of photographic processing apparatus according to the present invention, FIGS. 7 and 8 are diagrammatic side sectional views of another embodiment of apparatus according to the present invention, and FIGS. 9, 10 and 11 are diagrammatic side sectional views of a light baffle arrangement for use with an embodiment similar to that shown in FIG. 6.

The apparatus illustrated in FIG. 1 comprises a generally rectangular-outline basin 1 to provide a tempering water bath 2 for maintaining temperature conditions during processing. The basin 1 has an upstanding housing 3 mounted thereon for sliding movement longitudinally of the basin (from side to side of FIG. 1), the level of the tempering water bath 2 within housing 3 approaching the top wall 3*a* of the housing. A cylindrical hollow drum 5 is mounted between an upstanding wall 4 of the basin and an upstanding wall 6 of the housing so as to be angularly movable about a horizontal axis generally coaxial with the axis of the drum. By mounting the housing 3 slidably on the basin 1, drums 5 of different axial length can be accommodated. The drum 5 is closed at its axial ends by removable discs 7,8 each provided about its periphery with an O-ring seal to provide an air-tight seal against the cylindrical wall 9 of the drum.

The removable end closure disc 8 adjacent basin wall 4 has an outlet conduit 10 extending centrally therethrough. The outlet conduit 10 is generally L-shaped or cranked such that its outer end portion 11 rests on the upper end of basin wall 4 and such that its inner portion 12 extends downwardly to approach closely adjacent the cylindrical wall 9 of the drum. Thus the conduit 10 extends from adjacent the drum's cylindrical wall to, and through, the centre of closure disc 8. A rotationally air-tight O-ring seal is provided between the outlet conduit 10 and the disc 8 to permit said angular movement of the drum 5 whilst the outlet conduit 10 is held stationary, e.g. by means of a releasable clamp 13 securing the outlet conduit 10 on the upper edge of basin wall 4.

The removable end closure disc 7 adjacent housing wall 6 has a pair of coaxial conduits 14,15 extending therethrough and through the housing wall 6. The outer conduit 14 of the pair is a venting conduit and is connected by flexible tubing 16 to one inlet of a multi-inlet selector valve 17 supported by the top wall of the housing 3. The selector valve 17 has a fluid supply outlet 18 connected by flexible tubing 19 to the inlet of a manually operable pump 20 supported by the top wall of housing 3 and immersed in the tempering water bath 2 within housing 3. The outlet of pump 20 is connected by flexible tubing 21 to the inner conduit 15 of said pair of coaxial conduits so that conduit 15 can form a fluid supply conduit. A rotationally air-tight O-ring seal is provided between the outer venting conduit 14 and the disc 7, the latter having a baffle arrangement (not shown) to provide a trap or barrier to light entering the drum 5 from the outside when the conduits 14,15 are removed.

The removable end closure disc 7 is provided, e.g. integrally, with a gear wheel $G_1$ on its outer radial face and coaxial with the axis of the disc (and drum). An electrical motor M mounted on wall 6 externally of housing 3 is drivingly coupled to the drum 5 by means of an interconnecting gear wheel $G_2$. It will be appreciated that other means may be alternatively provided to transmit the drive from motor M to the drum 5.

In a particularly preferred form of this embodiment of the invention, the exemplary photographic processing equipment is to be used in effecting a five-stage process wherein exposed film material is placed in air-tight drum 5 and sequentially contacted by developer fluid in the first stage, by a bleach/fix fluid in the second stage, by a wash of water fluid in the third stage, by stabilizer fluid in the fourth stage, and by a final wash of water fluid in the fifth stage. If desired the processed material may be removed from the drum at the end of the fourth stage, the final fifth stage being used to clean the equipment for subsequent use. Fluid selection for each stage of the process is effected by the selector valve 17.

The selector valve 17 shown in FIGS. 2 to 5 has five inlets 22*a*, 22*b*, 22*c*, 22*d* and 22*e* (one for each fluid) provided by depending stub pipes equiangularly spaced in a circular array in the base 24 of a cylindrical cup-shaped valve housing 25, and has a fluid supply outlet 18 provided by a similar depending stub pipe disposed centrally of the base 24. The fluid inlets 22*a*, 22*b* and 22*d* are connected to three reservoirs 23 for respectively developer fluid, bleach/fix fluid and stabilizer fluid, and the fluid inlets 22*c* and 22*e* depend into the tempering water within housing 3. A venting stub pipe 31 depends from the base 24 of the valve housing at a location on the pitch circle of fluid inlets 22 and mid-way between two neighbouring fluid inlets 22. The upper surface of base wall 24 is machined or moulded to provide an annular channel 31*b* (coaxial with and radially inwardly of the fluid inlets 22) and a radial channel 31*a* interconnecting annular channel 31*b* and the upper end of stub pipe 31 (see FIG. 2). A gasket 40 of p.t.f.e. or other suitable material is superimposed on the base 24 and held non-rotatably in position. The gasket 40 is provided with two coaxial circular arrays of ports, the inner array comprising five ports 30*a*, 30*b*, 30*c*, 30*d* and 30*e* overlying and communicating with the annular channel 31*b*, and the outer array comprising five ports in registered alignment with the fluid inlets provided by stub pipes 22*a*, 22*b*, 22*c*, 22*d* and 22*e* and each equiangularly off-set mid-way between neighbouring pairs of the ports 30 (see FIG. 5).

A disc-like selector plate 126 is rotatably mounted within the valve housing 25 on gasket 40 and is provided with a passage 27 comprising a central vertically depending portion 27*a* permanently in registered alignment with the stub pipe of outlet 18 and a central port in gasket 40, a lateral vertical depending portion 27*b* for selective registered alignment with each of the stub pipes of inlets 22 as the plate 126 is rotated, an intermediate radial portion 27*c* interconnecting the vertical passage portions 27*a* and 27*b*, and a lateral vertically upstanding portion 27*d* in alignment with portion 27*b* for selectively supplying air to the drum 5 as the plate 126 is rotated. The rotary selector plate 126 is also provided with a single air vent bore 130 on the pitch circle of the ports 30 in gasket 40 and of the annular channel 31*b* in base 24.

The annular cover disc 128 secured to the cup-shaped valve housing 25 has an annular gasket 41 fitted in its lower surface for sealing contact of the upper surface of selector plate 126. The lower surface of gasket 41 is provided with five radially-directed slots 132 equiangularly spaced, each slot 132 being disposed diametrically opposite (in plan view) the location of a stub pipe providing a fluid supply inlet 22 and generally in the radial plane through an associated port 30 in the gasket 40 below (see FIG. 2).

The rotatable selector plate 126 is connected via a shaft 33 projecting centrally through the annular cover disc 128 to the control knob 34 (see FIG. 1), and the housing 25 of the selector valve 17 is mounted in air-tight relationship on the top wall 3*a* of housing 3 so that the control knob 34 is uppermost. Advantageously the inner periphery of annular cover disc 128 is provided with equiangularly spaced V-shaped teeth engageable by a spring-loaded ball mounted on shaft 33 thereby to provide a multiposition click-stop or detent mechanism.

In use of the equipment, the selector plate 126 is initially positioned in a rest position in which its passage portion 27*c* is directed radially mid-way between the port 30*e* in gasket 40 and the first fluid inlet port provided by stub pipe 22*a* (and the port in gasket 40 in registered alignment therewith). In this position gaskets 40 and 41 seal the ends of passages 27*b* and 27*d* so that all the fluid inlets 22 and all the air inlets to stub pipe 18 are closed, and gasket 41 seals the upper end of bore 130 so that no air can be vented therethrough. After loading the drum 5 in a dark-room with the photographic material to be processed and starting rotation of drum 5, the selector plate 126 is rotated on (clockwise when viewed as in FIGS. 3 and 5) to a first position (FIG. 2) of the first process stage in which its passage portion 27*b* is in registered alignment with the first fluid inlet port provided by stub pipe 22*a*, and its bore 130 is in communication both with the vent outlet slot 132 diametrically opposite fluid inlet stub pipe 22*a* and with the vent air inlet port 30*a* in gasket 40. The pump 20 is then operated to draw a predetermined quantity of the first processing fluid from the first reservoir 23 connected to fluid inlet stub pipe 22*a* and supply it therefrom via passage 27, outlet 18, flexible tubing 19, the pump 20, flexible tubing 21 and supply conduit 15 into the drum 5 to form this quantity as a puddle 35 of said first processing fluid in the bottom of drum 5. As the first processing fluid is supplied to the drum 5 it displaces air from the drum outwardly through the venting conduit 14, flexible tubing 16, stub pipe 31, radial channel 31*a*, annular channel 31*b*, bore 130 and the slot 132 communicating therewith to atmosphere. The selector plate 126 is then rotated on (clockwise when viewed as in FIGS. 3 and 5) to a second position of the first process stage in which its passage portion 27*a* is directed radially mid-way between the port 30*d* in gasket 40 and the first fluid inlet stub pipe 22*a* so that all the fluid inlets 22 and all the air inlets to stub pipe 18 (via slots 132) are closed and none of the slots 132 communicates with bore 130 to provide a vent outlet. The slots 132 in the gasket 41 are arranged in relation to passage portions 27*b*, 27*d* and bore 130 such that in the transition from said first to said second position of the selector plate 126, the fluid inlets 22 and air inlets to stub pipe outlet 18 are closed before a slot 132 comes out of communication with the bore 130 whereby, whilst this communication exists, continued operation of the pump 20 causes air to be sucked by the pump 20 through that slot 132, the passage portions 27*d*, 27*c* and 27*a*, outlet 18 and flexible tubing 19 for supply to drum 5 via flexible tubing 21 and supply conduit 15. This pump operation clears passage 27, tubing 19, 21 and conduit 15 of the first processing fluid. With the selector plate 126 in the second position, rotation of the drum 5 about its axis agitates the puddle 35 and distributes it evenly over the photographic material mounted inside the drum. After a predetermined time period, the selector plate 126 is rotated on (clockwise as viewed in FIGS. 3 and 5) to a third position (FIG. 4) of the first process stage in which its passage portion 27*d* is in communication with a slot 132 of the gasket 41 to provide an air inlet. The pump 20 is then operated again and draws air from atmosphere through this slot 132, passage portions 27*d*, 27*c* and 27*a*, outlet 18 and flexible tubing 19 to supply it from the pump 20 via flexible tubing 21 and supply conduit 15 to the drum so as to pressurise the drum and expel or force out of the drum through the cranked outlet conduit 10 the puddle 35 of the first processing fluid. The selector plate 126 is then rotated on (clockwise as viewed in FIGS. 3 and 5) to the next position which is an intermediate rest position (similar to the above-mentioned initial rest position of selector plate 126) and in which the passage portion 27*c* is directed radially mid-way between the port 30*d* in gasket 40 and the second fluid inlet port provided by the stub pipe 22*b* (and the port in gasket 40 in registered alignment therewith). Onwards rotation (clockwise as viewed in FIGS. 3 and 5) of the selector plate 126 from this intermediate rest position towards the above-mentioned initial rest position of selector plate 126 will effect a like opening and closing of the other ports 22*b* to 22*e* and of the slots 132 for successive stages of the process, the pump 20 being likewise operated at the first and third positions of the selector plate 126 in each stage. In the first position of the selector plate 126 for the first, second and fourth stages, operation of the pump supplies the drum 5 with respectively the first, second and fourth processing fluid from respective reservoirs 23, whereas in said first position for the third and fifth stages the pump supplies a washing fluid in the form of water from the tempering bath 2 in housing 3. At the end of the process, the electrical motor M is switched off to stop the drum's angular movement, and the processed photographic material removed from the drum interior.

It will be appreciated that angular movement of the drum 5 can be imparted thereto by other means, e.g. manually and/or via a frictional rotary drive mechanism and/or via a reciprocating drive mechanism. Such drive means, like the motor M, can be mounted on the upstanding wall 4 instead of the wall 6 to drive the drum, e.g. via the closure disc 8.

Although the pump 20 is illustrated as being manually-operable, it may alternatively be a hydraulically- or pneumatically- or electrically-operable pump for immersion in the tempering bath 2 within housing 3. The temperature of the water of the tempering bath 2 is preferably regulated by a thermostatically controllable electric heater (not shown); and the bath height is preferably regulated, e.g. by a float valve connected to mains supply or a header tank, to ensure that its surface level is above that of puddle 35 within drum 5.

It will be appreciated that with such an electric heater, an electric pump 20 and an electric motor for rotating or oscillating the drum 5, the process can be carried out automatically by electrical control means (including a time-setting device) providing signals (at and/or for predetermined time intervals) to such component and to an electrically responsive drive device (e.g. a stepping motor) operable to rotate the selector plate 26 of the valve 17.

Each of the three reservoirs 23 (connected respectively to the fluid inlets 22*a*, 22*b* and 22*d*) comprise a closed flexible bag or tube carried within housing 3. The upper end of the reservoir is connected in an air-tight manner to the associated stub pipe providing the fluid inlet 22, and the lower end of the reservoir is connected in an air-tight manner to a filler tube 36 that leads via a releasable clamp 37 to a filling funnel 38 (see FIG. 1). As the chemical solution of processing fluid within a reservoir 23 is removed for supply to drum 5, the wall(s) of the reservoir provided by the flexible bag or tube will deform inwardly. To avoid such deformation causing an undesired closure of the stub pipe providing the associated fluid inlet 22, the latter may be connected to an elongate flexible open coil 39 of non-corrosive rigid material (e.g. stainless steel), extending virtually the whole length of the reservoir 23.

By providing each reservoir 23 as an air-tight enclosure, its contents may be stored permanently free of air contact and thus avoid premature oxidation.

For filling a reservoir 23, the clamp 37 is released and the appropriate chemical solution required for that processing fluid is poured from a storage container into the associated filling funnel 38 which is raised to allow its contents to flow into the reservoir. After closing the clamp 37, any residual fluid between the clamp and filling funnel may be discarded or poured back into the storage container. If desired, this filling procedure may be effected with used processing fluid emanating from the outlet conduit 10.

In one possible modification of the above-described and illustrated exemplary equipment, the parts 36–38 may be omitted and filling of the reservoir 23 achieved via the valve 17 by reverse operation of the pump 20. In another possible modification of the above-mentioned and exemplary equipment, the parts 37,38 may be omitted and the removable closure 36 positioned above the level of the water bath 2, the flexibility of the reservoir 23 and coil 39 permitting this.

It will be appreciated that by connecting the pump 20 to the outlet 18 from valve 17, the valve can be of simple construction. Furthermore, the level of the tempering water 2 within housing 3 may be raised above that of the tempering water in basin 1 by withdrawing air from housing 3 either through an air extract valve (not shown) provided in the top wall of housing 3 and/or through the valve (possibly utilising a water inlet port 22) and/or through a length of tubing in a generally U-shape passing under the bottom of housing 3 and upwardly to each side of its side wall. Thus the various processing fluids can be maintained at their appropriate operating temperature whilst in the reservoirs 23, whilst flowing therefrom to the drum 5, and whilst in the drum.

The apparatus diagrammatically illustrated in FIG. 6 is similar to that described with reference to FIG. 1 and is operated in a similar manner and accordingly like reference numerals have been used to indicate like parts.

In the apparatus of FIG. 6 the reservoirs 23 are mounted in a container 150 adapted to contain a tempering fluid, preferably water, and an electric immersion heater 151 and thermostatic control means comprising a variable thermostat 152 and a thermistor 153 are provided for maintaining tempering fluid within the container 150 at a predetermined temperature. The drum 5 is mounted outside the container 150 and is not mounted in a tempering bath as in the embodiment of FIG. 1 but instead the exterior of the drum is covered with heat insulating material (not shown) for reducing heat loss from the interior of the drum.

The selector valve 17 can be similar to that already described with reference to FIGS. 2 to 5 but preferably includes one or more inlets 154 (corresponding to inlets 22*c* and 22*e*) which communicate with the interior of the container 150 so that water from the container 150 can be introduced into the drum to pre-heat the drum before the first processing stage and/or to wash the drum between stages of the processing cycle or at the end of the processing cycle.

By not mounting the drum 5 in a tempering bath, greater flexibility is provided in that the apparatus can readily be adapted to receive drums of different lengths, thus enabling economical use of processing fluids according to the size of photographic sheet material to be processed.

It has been found that so long as the drum 5 is adequately pre-heated and heat insulated there is no significant fall in the temperature of the processing fluids during the cycle time of the processing fluids in the drum.

The embodiment shown in FIGS. 7 and 8 is substantially the same as that shown in FIG. 6 and accordingly like reference numerals have been used to describe like parts. In the FIG. 6 embodiment the water for pre-heating the drum 5 and for washing the drum between stages in drawn from within the container 150 with the result that the water level therein falls and needs to be replenished from time to time. In the embodiment of FIGS. 7 and 8 the container 150 has a water jacket 155 therearound which is divided by a partition 156 into an upper processing water reservoir 157 and a lower displacement water reservoir 158. A conduit 159 connects one of the inlets of the selector valve 17 to the interior of the processing water reservoir 157 adjacent the top thereof so that water can be drawn from the reservoir 157 and passed to the drum. A conduit 160 connects a supply 161 of make-up water to the reservoir 157 so that as water is withdrawn from the reservoir 157 by operation of the pump 20 fresh make-up water will be drawn into the reservoir 157 from the supply 161. The peripheral wall of the container 150 is such that heat transfer will take place between the heated tempering water in the container 150 and the processing water and displacement water in reservoirs 157 and 158 to heat the water in reservoirs 157 and 158.

Displacement water reservoir 158 is in communication with the interior of the container 150 by way of a conduit 162 which extends from the bottom of the reservoir 158 to the height of the required water level in container 150. An air vent pipe 163 extends from the top of reservoir 158 to above the height of the required water level in container 150. A tubular sight glass 164 is provided exteriorly of the reservoir 158 and communicates at its upper and lower ends with the interior of the reservoir 158 so that the water level in the reservoir 158 can readily be seen. The capacity of the reservoir 158 is preferably substantially equivalent to the total capacity of the reservoirs 23. As processing fluid is withdrawn by pump 20 from the reservoirs 23 so these reservoirs will collapse and the water level in container 150 will fall by a corresponding amount, thus creating a slight drop in pressure in the container 150 above the water level therein. This slight drop in pressure in the container 150 causes water to be drawn from reservoir 158 into container 150 by way of conduit 162 so as to maintain a constant water level in container 150. As water is drawn from the reservoir 158 into the container 150 so the water level in reservoir 158 will fall and this fall in level will be readily visible in sight glass 164 and will provide an indication of the amount of processing fluid remaining in the reservoirs 23. When the reservoirs 23 are substantially empty and are refilled, water will be displaced from container 150 as the reservoirs 23 fill up and will flow via conduit 162 into the reservoir 158 to restore the level therein.

FIGS. 9, 10 and 11 show a light baffle arrangement which is particularly suitable for use with an embodiment similar to that shown in FIG. 6 and which enables the drum 5 to be removed whilst it has light-sensitive photographic material therein within any danger of light entering the drum and causing damage to the light-sensitive photographic material.

The light baffle arrangement shown comprises a cylindrical inlet 165 coaxially of one end of the drum 5 and having an inner end 166 which extends into the drum 5. A ring magnet 167 is provided around the inner end 166 of the inlet 165 and serves to retain a light baffle 168 of magnetic material against the inner end of the inlet 165 when the drum 5 is removed from the coaxial conduits 169, 170 which correspond to the coaxial conduits 15, 16 of FIGS. 1 and 6. A locating ring 171 is provided on the light baffle 168 which is adapted to enter the inner end 166 of the inlet 165 to centre the baffle 168 thereon.

The inner coaxial conduit 169 has a side delivery nozzle 172 adjacent its outer end and a magnet 173 at its outer end, the nozzle 172 and the magnet 173 extending beyond the end of the outer coaxial conduit 170. The outer coaxial conduit 170 is a close sliding fit in the inlet 165 of the drum 5 and has an O-ring seal 174 adjacent the outer end thereof which makes sealing engagement with the inner surface of the inlet 165. The distance by which the inner coaxial conduit 169 projects beyond the end of the outer coaxial conduit 170 is slightly less than the length of the inlet 165 so that the seal 174 will engage the inner surface of the inlet 165 before the magnet 173 engages the light baffle 168. Thus, as the drum is inserted onto the coaxial conduits 169, 170 as shown in FIGS. 10 and 11, first the seal 174 will engage the inner surface of the inlet 165 and then the magnet 173 will engage the light baffle 168 and will displace the light baffle 168 inwardly away from the end of inlet 165, the light baffle 168 being magnetically retained on the magnet 173. When the drum 5 is removed from the coaxial conduits 169, 170 the above sequence of events are reversed, the light baffle 168 being transferred from the magnet 173 to the magnet 167 to close the inlet 165 before the seal 174 moves out of sealing engagement with the inlet 165.

The drum 5 is releasably retained in assembled relation with the coaxial conduits 169, 170 by an annular spring retainer 175 which engages in an annular groove 176 in the outer end of the inlet 165.

In the embodiment shown in FIGS. 8,9 and 10 the outer coaxial conduit 170 is mounted in a bearing 177 in a casing part 178 for rotation by the motor M (FIG. 6) and serves to impart the rotary drive to the drum 5. An annular spider member 179 is provided between the inner and outer coaxial conduits 169 and 170 so as to maintain the spacing therebetween.

In the illustrated embodiments the apparatus is shown as comprising a processing chamber in the form of a drum 5. It will be understood, however, that other forms of processing chamber can be used if desired. A particularly advantageous alternative form of processing chamber is provided by a shallow rectangular box-like container which comprises a lid which can be opened to enable a sheet of photographic material to be placed in the container. Such box-like container is preferably mounted for reciprocating angular movement about an axis of rotation which is parallel with the two major walls of the container and which extends through diagonally opposite corners of the container. With such an arrangement the discharge passage from the container is preferably provided in a lower corner of one of those corners of the container which contains the rotational axis and the container is preferably tiltable about an axis extending at right angles to the rotational axis so that when tilted the corner in which the discharge passage is provided will be the lowermost corner, thus facilitating the discharge of processing fluid from the chamber. The use of a shallow rectangular box-like container has advantages over a drum when small single sheets of photographic material are to be processed since with a drum suitable spacers have to be used to retain small sheets in position in the drum whereas with the box-like container small sheets can simply be laid flat therein.

What I claim is:

1. Photographic processing apparatus comprising a substantially air-tight chamber mounted for angular movement about an axis, at least one reservoir for a photographic processing fluid, pump means for introducing processing fluid into and discharging it from the interior of said chamber, and valve means for controlling the introduction of processing fluid into and discharge of processing fluid from the interior of said chamber, the outlet of the pump means being connected to the interior of the chamber and the valve means being operable to connect the inlet of the pump means either to said at least one reservoir so that processing fluid may be withdrawn from said at least one reservoir and introduced into the chamber or to atmosphere so that air under pressure can be introduced into the chamber to force processing fluid therein out of the chamber through a chamber outlet.

2. Apparatus according to claim 1, wherein said chamber comprises a hollow cylindrical chamber mounted for angular movement about its axis.

3. Apparatus according to claim 2, wherein said drum comprises a cylindrical peripheral wall and end closure members at least one of which is removable so that photographic sheet material to be processed can be introduced into the drum.

4. Apparatus according to claim 1, wherein said chamber is a shallow box-like chamber.

5. Apparatus according to claim 4, wherein said chamber is provided by a shallow rectangular box-like container which is mounted for angular movement about an axis which extends through diagonally opposite corners of the container and is parallel with the two opposed major walls of the container.

6. Apparatus according to claim 1, wherein a discharge passage communicates with the interior of said chamber at the axis thereof.

7. Apparatus according to claim 6, wherein said discharge passage is provided by a conduit one end of which is disposed internally of said drum adjacent its peripheral wall so as to be immersed in a puddle of processing fluid in the drum when processing fluid had been introduced into the drum.

8. Apparatus according to claim 6, wherein an inlet passage communicates with the interior of the chamber at the axis thereof, said discharge passage extending through one end of the chamber and said inlet passage extending through the opposite end of the chamber.

9. Apparatus according to claim 8, wherein an air vent passage is provided coaxially of said inlet conduit.

10. Apparatus according to claim 1, wherein said at least one reservoir is formed from flexible material whereby it will collapse as processing fluid is withdrawn therefrom.

11. Apparatus according to claim 10, wherein the or each reservoir is provided with filler means whereby it can be refilled with processing fluid.

12. Apparatus according to claim 10, wherein a plurality of reservoirs for processing fluid are provided and wherein said valve means is adapted to selectively connect any one of said reservoirs to the inlet of said pump means.

13. Apparatus according to claim 1, wherein said at least one reservoir is mounted in a bath or container adapted to contain a tempering fluid for maintaining processing fluid in the reservoir at a predetermined temperature.

14. Apparatus according to claim 13, wherein heating means is provided for heating a tempering fluid in said bath or container.

15. Apparatus according to claim 14, wherein thermostatic means is provided for maintaining a tempering fluid in said bath or container at a predetermined temperature.

16. Apparatus according to claim 1, wherein said chamber is mounted in a bath adapted to contain a tempering fluid for maintaining processing fluid in the chamber at a predetermined temperature.

17. Apparatus according to claim 16, wherein the or each said reservoir and said chamber are mounted in a common tempering bath.

18. Apparatus according to claim 1, wherein the exterior of said chamber is covered with heat insulating material to reduce heat loss from the chamber.

19. Apparatus according to claim 1, wherein an electric motor is provided for rotating or oscillating said chamber.

20. Apparatus according to claim 1, wherein said pump means comprises a manually operable pump.

21. Apparatus according to claim 1, wherein said valve means is manually operable.

22. Apparatus according to claim 1, wherein said pump means comprises an electrically operable pump.

23. Apparatus according to claim 22, wherein control means is provided for automatically operating said pump means and said valve means according to a predetermined timed sequence.

24. Apparatus according to claim 1, comprising a sealed container for said at least one reservoir, said container being adapted to contain a tempering liquid, means for heating said tempering liquid and means for maintaining said tempering liquid at a constant predetermined temperature.

25. Apparatus according to claim 24, wherein said container has a water jacket therearound, a partition dividing said water jacket into an upper processing water reservoir and a lower displacement water reservoir, means connecting said upper reservoir to the inlet of said pump means via said valve means so that water can be selectively withdrawn from said upper reservoir and supplied to said chamber, means connecting the lower part of said lower reservoir with the interior of said container at the height of the required water level therein, said at least one reservoir for processing fluid being adapted to collapse as fluid is withdrawn therefrom, and sight glass means exteriorly of said water jacket for indicating the water level in said lower reservoir, whereby as fluid is withdrawn from said at least one reservoir for processing fluid and such reservoir collapses make-up water will pass from said lower reservoir into said container to maintain the tempering liquid level in the container, the fall in level of water in the lower reservoir being visible in said sight glass and serving to indicate the quantity of processing fluid remaining in said at least one reservoir.

26. Apparatus according to claim 1, wherein said chamber comprises a hollow cylindrical drum mounted for angular movement about its axis and having a cylindrical inlet coaxially of one end thereof, said drum being removably mounted on a rotatable air vent conduit for rotation therewith, means for rotating said air vent conduit and said drum, sealing means between said air vent conduit and said cylindrical inlet, and an inlet conduit mounted within and coaxially of said air vent conduit through which processing fluid or air can be pumped into said drum by said pump means.

27. Apparatus according to claim 26, wherein said cylindrical inlet projects into the interior of said drum, a ring magnet around the inner end of said cylindrical inlet, and light baffle means of magnetic material adapted to be magnetically retained by said ring magnet and to close said cylindrical inlet when said drum is removed from said air vent conduit.

28. Apparatus according to claim 27, wherein said inlet conduit projects outwardly beyond said air vent conduit and has a magnet on the outer end thereof adapted to displace said light baffle means away from said cylindrical inlet and to magnetically retain the light baffle means when the drum is mounted on said air vent conduit, said sealing means being arranged to make sealing engagement with said cylindrical inlet before said light baffle means is displaced.

29. Apparatus according to claim 28, wherein means is provided for centering said light baffle means on said cylindrical inlet.

* * * * *